US007802794B1

(12) United States Patent
Zorrilla Perez

(10) Patent No.: US 7,802,794 B1
(45) Date of Patent: Sep. 28, 2010

(54) BASEBALL BOARD GAME

(76) Inventor: Jose Luis Zorrilla Perez, P.O. Box 00936-4732, San Juan, PR (US) 00936-4732

( * ) Notice: Subject to any disclaimer, the term of this patent is extended or adjusted under 35 U.S.C. 154(b) by 0 days.

(21) Appl. No.: 12/381,820

(22) Filed: Mar. 16, 2009

(51) Int. Cl.
*A63F 3/00* (2006.01)

(52) U.S. Cl. ..... 273/244.2; 273/259; 273/277

(58) Field of Classification Search ..... 273/244.1, 273/244.2, 259, 277
See application file for complete search history.

(56) References Cited

U.S. PATENT DOCUMENTS 1,672,478 A * 6/1928 Wible ..... 273/244.2
2,933,316 A * 4/1960 Mancini ..... 273/244.2

* cited by examiner

*Primary Examiner*—Vishu K. Mendiratta

(57) ABSTRACT

A game board comprising a board, wherein said game board simulates a baseball field. The board is divided in two principal sections, wherein one of the sections is denoted as the infield and the other as the outfield. The infield comprises two tracks connecting each base and the outfield is sub-divided in at least 9 sections representing a particular outfield position. The game also comprises cards with printed instruction, figures representing the players, and dices with particular indicia. A player can win the game by scoring the most runs at the end of the nine 9 innings or by hitting 7 runs with the Mega Slam at any point of the game.

6 Claims, 9 Drawing Sheets

| | |
|---|---|
| H-1<br>Pitchers throw is **Wild**<br>Runners advance 1 base<br>**Defensive by pitcher....MINUS - .50** | H-2<br>That was the fourth ball pitched outside the strike zone. It is a base on balls. Batter takes **A** or **C** base<br>**Defensive by Pitcher...MINUS -.75** |
| H-3<br>Pitcher winds up but throw is **Wild.**<br>Runners advance one base.<br>**Defensive by Pitcher...MINUS -.50** | H-4<br>It is a legally pitched ball but the **Catcher fails to hold it.** Runners Advance one base. **Passed ball.**<br>**Defensive by Catcher....MINUS -.75** |
| H-5<br>**HOME RUN**<br>**Why don't you go for the** MEGA SLAM? | H-6<br>**HOME RUN**<br>**Why don't you go for the** MEGA SLAM? |
| H-7<br>It's a **HOME RUN** by the left field | H-8<br>Two foul tips and one strike is ...**OUT** |
| H-9<br>**It is a difficult foul fly. The Catcher is determined, goes for it and makes a beautiful play. It is OUT**<br>**Defensive by Catcher....PLUS + 1.00** | H-10<br>Three strikes is **OUT** |

PC

Figure 5a

| | |
|---|---|
| H-11<br><br>It is the thirds strike. Batter is OUT | H-12<br><br>It's a Pitch-Out, Catcher and runner go for the steal of **B-Base**. Runner over slides. It is OUT<br><br>Defensive by Catcher....PLUS +.30 |
| H-13<br><br>It is the third strike.<br>Batter is OUT | H-14<br><br>That was the forth ball pitched outside the strike zone. It is a Base on balls. Batter takes A or C base. Runners advance one base.<br><br>Defensive by Pitcher....MINUS - .75 |
| H-15<br><br>It is a difficult foul fly. The Catcher is aggressive, goes for it and makes a marvelous play! It is OUT.<br><br>Defensive by Catcher....PLUS + 1.00 | H-16<br><br>Hard grounder between SS and B Base. No way to stop that hit. Batter takes either A or C base. Runners advance. |
| H-17<br><br>It is a PITCH OUT,<br>Runner goes for the steal of B Base but over slides and is OUT. Good throw by the catcher.<br><br>Defensive by Catcher....PLUS + .25 | |

Figure 5b

| | |
|---|---|
| LF-18<br>Deep high fly to the left bleachers. Fielder is there under the ball, but a spectator reaches out and ruins the catch. The **UMPIRE declares** interference. It is **OUT**.<br>Defensive by LF3 fielder PLUS +.50 | LF-19<br>HOME RUN by the left field |
| LF-20<br>Double to the left field<br>Runners take or advance 2 bases | LF-21<br>Single hit to the left field<br>Runners take or advance 1 base |
| LF-22<br>Double to the left field<br>Runners take or advance 2 bases | LF-23<br>Long bouncer to CF3. Fielder quickly returns the ball to the infield and keeps it as double.<br>Defensive by CF3 fielder PLUS +.75<br>Closing on to B-base by 1 zone |
| LF-24<br>Single to the left field<br>Offensive: normal<br>Defensive: poor MINUS -.50<br>Runners take or advance 1 base | LF-25<br>Slow drive to LF3. It is a Double, but slow return of the ball to the infield allows the batter to extend it to a Triple.<br>Defensive by LF3 MINUS -.50<br>Offensive by batter PLUS +.50 |
| LF-26<br>Ladies and gentlemen, a **Time-Out** has been called by the main **Umpire.** A beautiful Schnauzer pet by the name of **Pipo** is running and sniffing the field. We will have to wait. | LF-27<br>Single hit to the left field.<br>LF3 **tries hard,** but can not catch it.<br>Runners take or advance 1 base.<br>LF3 closes on to C base by 1 zone |
| LF-27<br>Ladies and gentlemen, a **Time-Out** has been called by the main **Umpire.** A beautiful Schnauzer pet by the name of **Pipo** is running and sniffing the field. We will have to wait. | LF-28<br>Single hit to the left field.<br>LF3 **tries hard,** but can not catch it.<br>Runners take or advance 1 base.<br>LF3 closes on to C base by 1 zone |

Figure 5c

| | |
|---|---|
| CF-29<br><br>Double to the Mid Center Field.<br>CF approaches B base by 1 zone.<br><br>Runners take or advance 1 base | CF-30<br><br>Single to Far Center Field<br>CF return is impeccable and<br>approaches B base by 2 zones.<br><br>Defensive by CF PLUS +.75 |
| CF-31<br><br>Single to mid center field.<br>Fielder approaches B base by<br>1 zone.<br><br>Runners take or advance 1 base. | CF-32<br><br>**Single to Mid Center Field**<br>**Runners take or Advance 1 base**<br>Fielder approaches B base by 1 Zone |
| CF-33<br><br>Double to the mid center field.<br>CF approaches B base by 1 zone.<br><br>Runners take or advance 1 base | CF-34<br><br>High fly deep to the C-Fielder who<br>can not catch it but the R-Fielder<br>in a desperate run with his back to<br>the public makes the OUT.<br><br>Defensive brilliant PLUS + 1.00 |
| CF-35<br><br>Long drive to the C-Field wall.<br>C-Fielder returns the ball quickly to<br>the infield and keeps it as a Double.<br><br>Runners take or advances 2 bases<br>Defensive very good PLUS + .50<br>CF approaches B base by 2 zones | CF-36<br><br>Single hit to the C-Field<br>batter takes A or C base<br><br>Runners advance 1 base |

Figure 5d

| | |
|---|---|
| LF-37<br>It's a Pop to the **Right Field** on fair territory, **C-baseman** tries hard but he can't reach it. Batter takes B base for a double.<br>**Defensive by C-baseman....PLUS +.50** | LF-38<br>**Single** hit to the **Right Field**<br>Runners take or advance 1 base<br>Defensive normal |
| LF-39<br>Triple hit to the Rght Field<br>Runners take or advances 3 bases<br>**Defensive erratic by RF3 MINUS -.75** | LF-40<br>Double to the Right Field<br>Runners take or advance 2 bases<br>**Offensive normal**<br>**Defensive normal** |
| LF-41<br>It is a hit, single by the right field | LF-42<br>Low **Lazy Fly** to the Right Field on fair area. **B base-man** tries hard but he can't catch it. Batter takes B-base for a double<br>**Defensive by B-Baseman PLUS +.50** |
| LF-43<br>**Triple hit to the right field**<br>**Runners take or advance 3 bases**<br>**Defensive erratic MINUS -.75** | LF-44<br>**Single to the right zone**<br>**Runners take or advance 1 base** |

Figure 5e

| | | 1 | 2 | 3 | 4 | 5 | 6 | 7 | 8 | 9 | Total |
|---|---|---|---|---|---|---|---|---|---|---|---|
| Visitor | Runs | | | | | | | | | | |
| | Defensive | | | | | | | | | | |
| | Base Runner Brought Fwd | | | | | | | | | | |
| | Outs | 0 0 0 0 0 | 0 0 0 0 0 | 0 0 0 0 0 | 0 0 0 0 0 | 0 0 0 0 0 | 0 0 0 0 0 | 0 0 0 0 0 | 0 0 0 0 0 | 0 0 0 0 0 | |

SC

| | | 1 | 2 | 3 | 4 | 5 | 6 | 7 | 8 | 9 | Total |
|---|---|---|---|---|---|---|---|---|---|---|---|
| Home | Runs | | | | | | | | | | |
| | Defensive | | | | | | | | | | |
| | Base Runner Brought Fwd | | | | | | | | | | |
| | Outs | 0 0 0 0 0 | 0 0 0 0 0 | 0 0 0 0 0 | 0 0 0 0 0 | 0 0 0 0 0 | 0 0 0 0 0 | 0 0 0 0 0 | 0 0 0 0 0 | 0 0 0 0 0 | |

Figure 8

BASEBALL BOARD GAME

STATEMENT REGARDING FEDERALLY SPONSORED RESEARCH AND DEVELOPMENT

N/A

BACKGROUND OF THE INVENTION

1. Field of the Invention

The present invention relates generally to a baseball game, more particularly it relates to a competitive baseball board game wherein the infield and outfield are designed to provide alternative movements for the players movement in order to make a more fun and entertainment game for those playing the game.

2. Discussion of the Background

Currently several baseball games are played using common baseball rules such as running the bases in just one direction and the limitations of offensive players standing at a particular base. Those baseball rules seem to be unfair, especially for kids, that after hitting a ball while playing as the offensive player have to run towards an empty base where a defensive player is waiting just to tag the player. The present rules limit the options for the offensive players since no alternative movement is provided by the game rules and game board structure. Therefore there is a need for a new an improved game that provides more options, especially for kids, in order to make the game more interesting and fun.

The present invention overcomes the disadvantages of previous baseball game boards providing a board structure related to a baseball field comprising an area denoted as the infield and a second area denoted as the outfield, wherein said infield has several base representations and several tracks connecting each base for a total of four tracks segments connecting each base. The connection between the bases and the tracks segments form a squared-like infield wherein each track segment comprises two parallel tracks connected to said base representation structure at said track segment distal end in order to form a quadrangle to allow for the runner to run in both directions. The players figure motions and/or action are provided by the use of the dice and the cards which randomly shows the play to be made. Further, the outfield has been divided into 9 zones in order that the performance of the outfielders can be recorded.

BRIEF DESCRIPTION OF THE DRAWINGS

The accompanying drawings which are incorporated herein constitute part of the specifications and illustrate the preferred embodiments of the invention.

FIGS. 5*a*-5*e* shows the back part of the game cards.

FIG. 8 shows the score cards.

DESCRIPTION OF THE PREFERRED EMBODIMENT

The Game Structure

The present invention discloses a game board structure comprising several player representation P1,P2, playing cards PC, a pair of dice, a starting chip and a board game 1.

Figure 1:
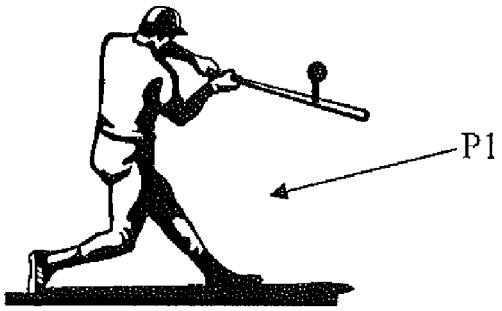
FIG. 1 is a representation figure of a first player.
Figure 2:
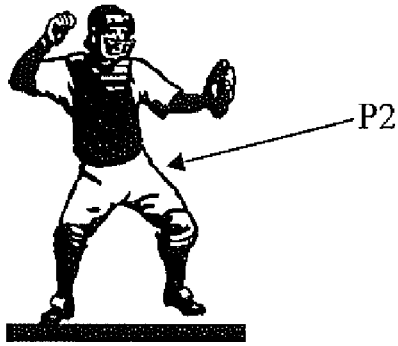
FIG. 2 is a representation figure of a second player.

FIG. 1 and FIG. 2 disclose player representation figures P1,P2. The present game is provided with at least 14 figures. The figures P1,P2 are designed to be identified into two different groups. The first group of figures P1 represents a first player and the second group of figures P1 represents the second player. For example the first and second group may be shaped similarly but different in color.

Figure 3:
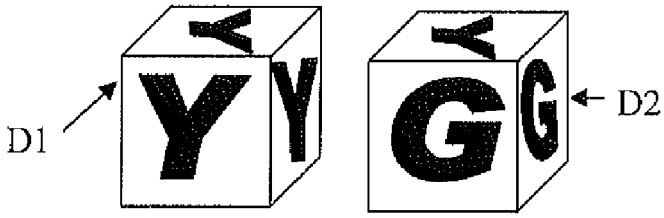
FIG. 3 is a representation of the pair of dice.
Figure 4:
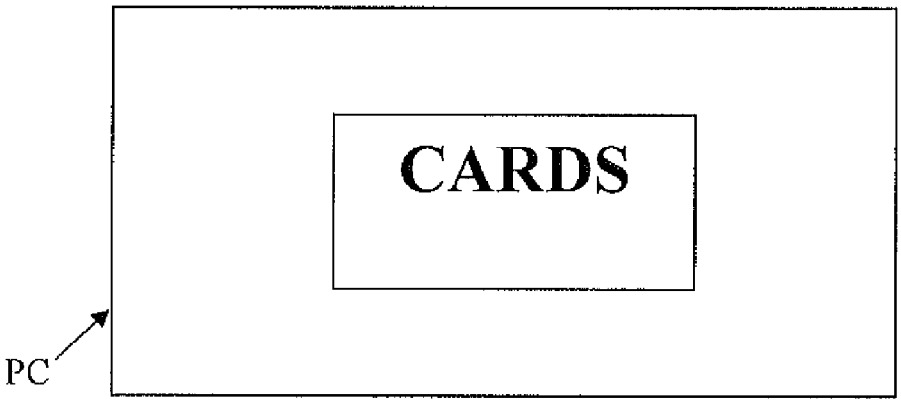
FIG. 4 is a representation of game cards.

The cards PC and a pair of dice, as shown in FIG. 3 and FIG. 4, are provided to randomly show the movement or action to be followed by the players. Each dice is marked with particular indicia on each side such as green and/or yellow colored marks. In the instant case, the first dice D1 has three sides in yellow color and three sides in green color; and the second dice D2 has four sides in green color and two sides in yellow color. Upon rolling the dice the result combination of indicia represent a predetermined action. For example, if the player rolls two dice of the same color regardless if they are green or yellow you are out by 1 out of the 3 outs of the inning.

The cards PC, as shown in FIG. 4 and FIG. 5, are used in combination with the dice. Each back part of the cards PC is printed with instruction to be followed by the players. The instructions, as shown in FIGS. 5*a*-5*e*, discloses the action to be performed by the offensive player at the top of the back part of the card and/or the action to be performed by the defensive player. For example and as part of the method of playing the game, if a player gets 2 different colors he/she must draw a card and each player must follow the instructions in said card.

Figure 6:
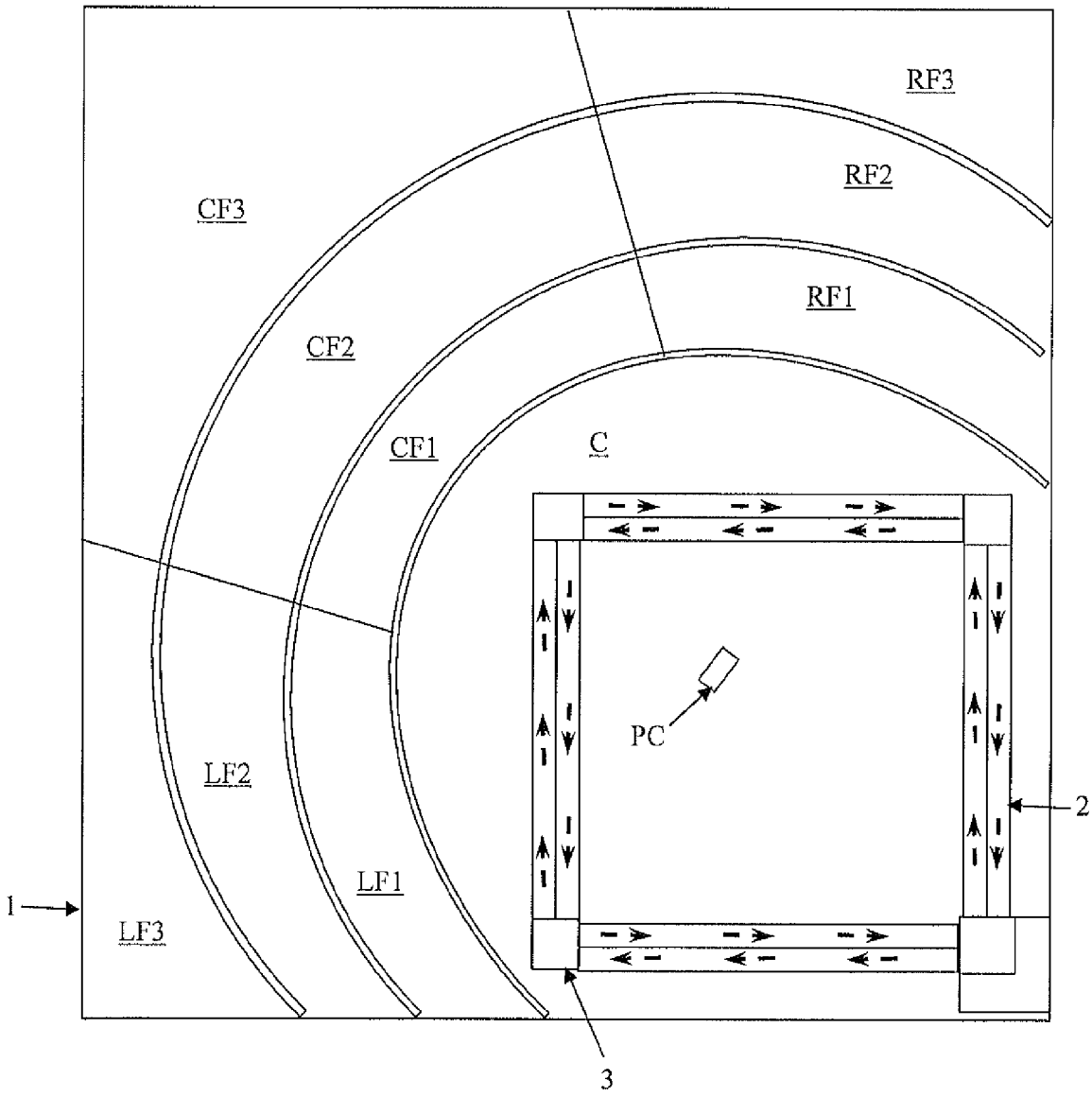
FIG. 6 is a top view of the game board.

FIG. 6 discloses a board game 1 comprising a first and a second area, wherein said first area is denoted as the infield and a second area is denoted as the outfield. The outfield is primarily divided in 3 groups LF, CF, RF of three segments LF1, LF2, LF3, CF1, CF2, CF3, RF1, RF2 and RF3 for a total of 9 sections. The 9 sections are provided to establish demarcation areas in order to be able to assign defensive or offensive performance to the outfielders.

Figure 7:
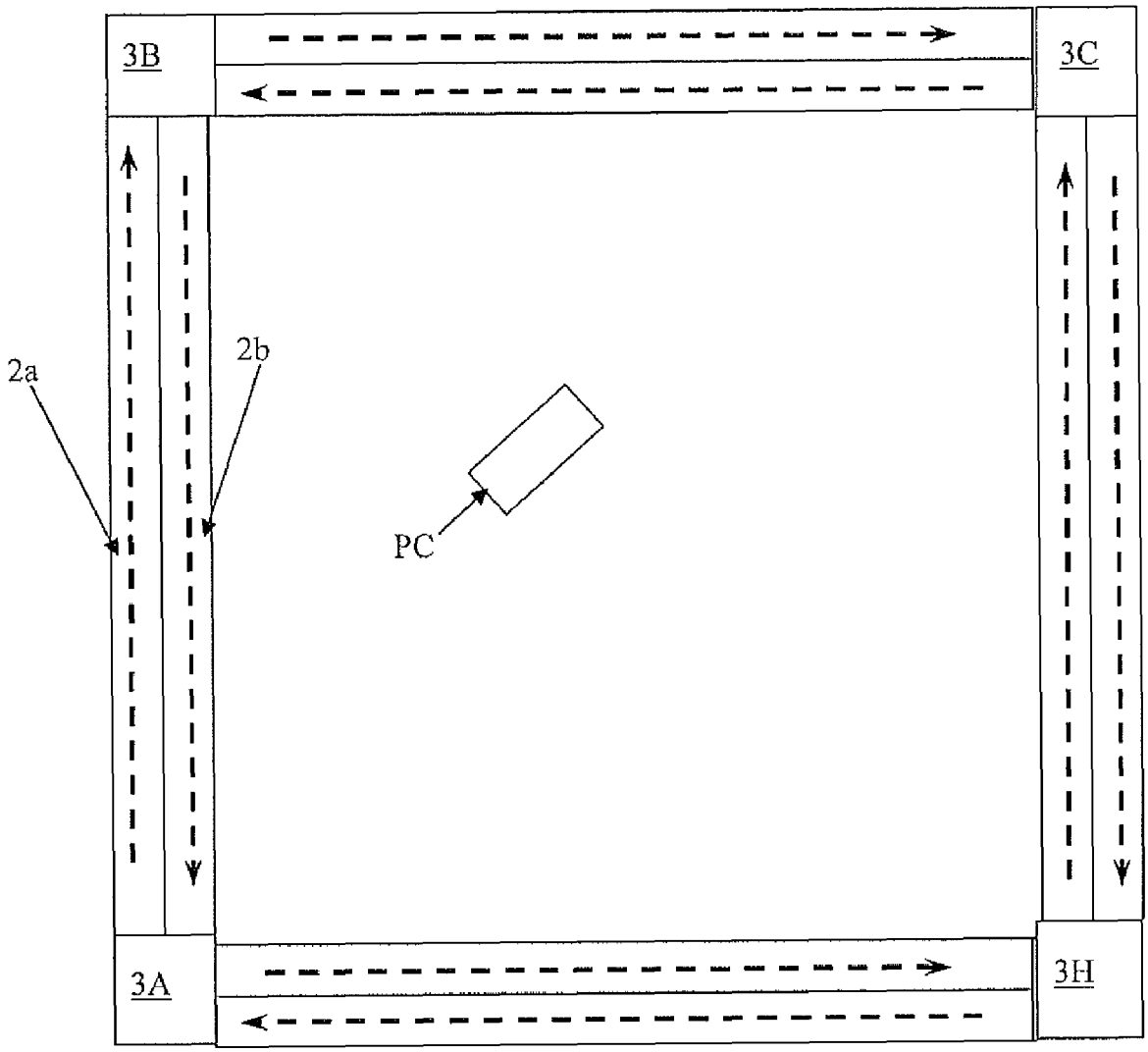
FIG. 7 shows an exploded view of the baseball infield at the game board.

The infield, as shown in FIG. 6, comprises several base representations 3 and several tracks segments 2 connecting each base representation 3 for a total of four tracks segments 2. FIG. 7 is a more detailed infield, wherein said infield comprises 4 bases 3A,3B,3C,3H connected by the tracks segments forming a squared-like infield. Each track segment 2 comprises two parallel tracks 2*a*,2*b* connected to said base representation structure 3A,3B,3C,3H at said track segment 2 distal end in order to form said quadrangle to allow for the runner to run in both directions. The outer track 2*a* is used for the clockwise movement of figures P1,P2 and the inner track 2*b* is used for the counter clockwise movement of figures P1,P2. FIG. 8 discloses the score card which is used to keep record of certain game board situations.

Visitor and Home teams will be determined by tossing the starting chip depicting Visitor or Home. The Visitor team will bat first while the Home team will select their team color.

The batting team will throw the dice and their combination will determine the action to follow. For example, drawing two dice of the same color is out while two dice of different colors require you to pick a card. When the card is drawn, the card must be read by the opposing team out loud and mimicking a sports broadcaster. The batting team will follow the described play with outmost care and will use one or both tracks to place its runners in an attempt to score runs and accommodate runners at bases in preparation for the possibility of the Mega Slam. To this effect runners left at bases at the end of the previous inning will be carried into the next inning and placed back to the bases where they were left off. Loading the bases will provide for a better chance to hit the Mega Slam.

Runners left on bases at the end of each inning will be carried forward into the next inning and placed again at the bases where they had been left off.

While the invention has, been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

The invention claimed is:

1. A baseball game board comprising;

player representation figures, a pair of dices, score cards, and a board comprising a playing area, wherein said playing area comprises a infield area wherein said infield area comprises structural representation of bases and plurality of tracks having segments, wherein each track segment has a first and second track connected in parallel and having arrows indicating opposite directions and wherein each base representation structure is connected at the distal end of said track segment;

and an outfield wherein said outfield is divided in three groups and each group is subdivided in three sections.

2. A baseball game board as in claim 1 wherein said infield comprises four base representations and said tracks segments connect the four bases representations to form a quadrangle.

3. A board game as in claim 1 wherein the pair of dices comprises colored sides between green and yellow, wherein a first dice has a ratio of green and yellow of 3/3 and a second dice has a ratio of green and yellow of 4/2.

4. A board game as in claim 1 wherein the pair of dices comprises a first dice having six faces, wherein three faces of said first dice six faces are marked with a first indicia and wherein three faces of said first dice six faces are marked with a second indicia, and a second dice having six faces, wherein three faces of said second dice six faces are marked with a first indicia and wherein three faces of said second dice six faces are marked with a second indicia.

5. A baseball game board comprising;

player representation figures, a pair of dices, score cards, and a board comprising a playing area, wherein said playing area comprises a infield area and an outfield area, wherein said infield area comprises several location segments and plurality of path segments, wherein each location segment comprises a single area defined by the contour of an uninterrupted line, wherein each path segment comprises a elongated segment having a distal end and a proximal end, wherein the elongated segment is divided in a first track segment and a second track segment connected in parallel and having arrows indicating opposite directions, wherein each distal end contacts one location segment and the proximal end of the same elongated segment contacts another location segment;

and an outfield wherein said outfield is divided in three groups and each group is subdivided in three sections.

6. A baseball game board as in claim 5, wherein said infield comprises four base representations and said tracks segments connect the four bases representations to form a quadrangle.

* * * * *